United States Patent [19]

Pollock

[11] 4,360,565

[45] Nov. 23, 1982

[54] IRON-CONTAINING REFRACTORY BALLS FOR RETORTING OIL SHALE

[75] Inventor: Lyle W. Pollock, Bartlesville, Okla.

[73] Assignee: Phillips Petroleum Company, Bartlesville, Okla.

[21] Appl. No.: 9,627

[22] Filed: Feb. 6, 1979

Related U.S. Application Data

[62] Division of Ser. No. 837,130, Sep. 28, 1977, Pat. No. 4,160,719.

[51] Int. Cl.[3] ..... B32B 15/02

[52] U.S. Cl. ..... 428/404

[58] Field of Search ..... 427/216, 217, 215; 428/402, 403, 404, 469, 542, 900; 264/8, 7, 5, 15; 201/12, 42; 208/11 R; 209/223 R, 214, 215

[56] References Cited

U.S. PATENT DOCUMENTS

| | | | |
|---|---|---|---|
| 2,315,725 | 4/1943 | Möller | 427/216 |
| 2,631,353 | 3/1963 | Robinson | 428/402 |
| 3,020,209 | 2/1962 | Culbertson, Jr. et al. | 202/14 |
| 3,265,608 | 8/1976 | Crawford | 208/11 |
| 3,353,910 | 11/1967 | Cornelius | 428/402 |
| 3,684,090 | 8/1972 | Kilbride | 209/214 |
| 3,736,181 | 5/1973 | Pye | 427/215 |
| 3,861,849 | 1/1975 | Richmond et al. | 264/8 |
| 3,963,827 | 6/1976 | Acres et al. | 428/403 |

FOREIGN PATENT DOCUMENTS

| | | | |
|---|---|---|---|
| 827016 | 1/1960 | United Kingdom | 427/217 |
| 936174 | 9/1963 | United Kingdom | 427/217 |
| 1308604 | 2/1973 | United Kingdom | 427/217 |

OTHER PUBLICATIONS

Cline et al., Vapor Deposition Of Metals On Ceramic Particles, Electrochemical Society Journal, vol. 98, 1951 pp. 385–387.

Penner et al., Energy vol. II, Non-Nuclear Energy Technology, pp. 10–29, 1975.

*Primary Examiner*—Stanley S. Silverman

[57] ABSTRACT

Iron-containing refractory balls, in a retorting process for oil shale, permit effective magnetic separation of the balls from the spent shale.

5 Claims, 1 Drawing Figure

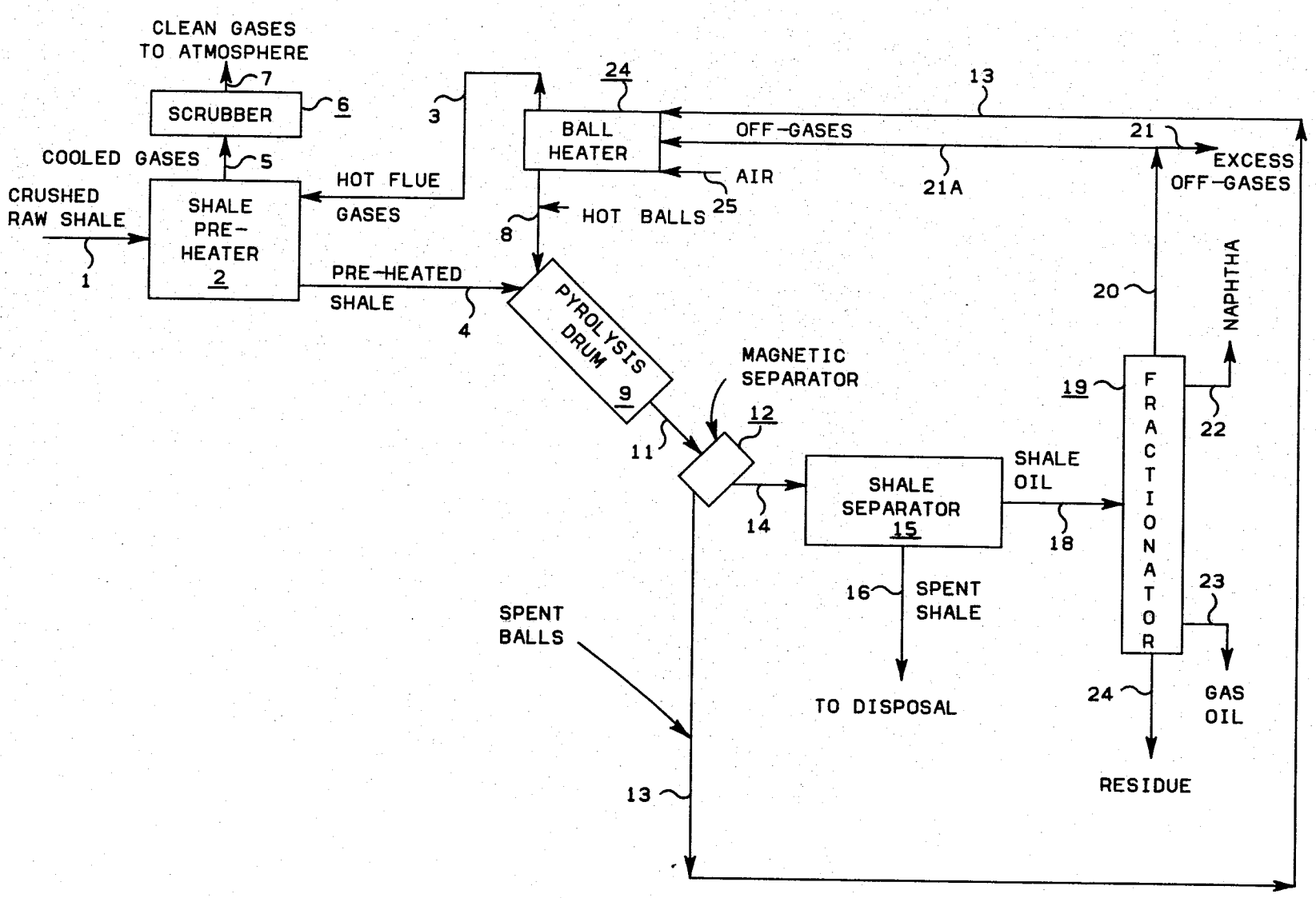
CRUSHED RAW SHALE
1
COOLED GASES
SHALE PRE-HEATER 2
5
SCRUBBER
6
7
CLEAN GASES TO ATMOSPHERE
HOT FLUE GASES
3
PRE-HEATED SHALE
4
PYROLYSIS DRUM 9
8
HOT BALLS
BALL HEATER
24
25
AIR
OFF-GASES
13
21A
21
EXCESS OFF-GASES
11
MAGNETIC SEPARATOR
12
14
SHALE SEPARATOR 15
16
SPENT SHALE
TO DISPOSAL
SHALE OIL
18
FRACTIONATOR
19
20
NAPHTHA
22
23
GAS OIL
24
RESIDUE
13
SPENT BALLS

IRON-CONTAINING REFRACTORY BALLS FOR RETORTING OIL SHALE

This is a divisional Application of Ser. No. 837,130 filed Sept. 28, 1977, now U.S. Pat. No. 4,160,719, July 10, 1979.

FIELD OF THE INVENTION

The invention pertains to the retorting of oil shale. In another aspect, the invention pertains to iron-containing ceramic balls.

BACKGROUND OF THE INVENTION

Oil shale is the colloquial term for a wide variety of laminated sedimentary rocks containing organic matter that can be released predominantly only by destructive distallation. While some removal of organic matter by solvents is possible, the amount so removed is quite small and is not feasible on an economical basis. This characteristic permits a clear distinction from tar sands which are rock or sand formations actually impregnated with oil.

Oil shales generally contain over one-third mineral matter. The organic portion, a mixture of complex chamical compounds, has been termed "kerogen". Kerogen is simply a generic name for the organic material found in such circumstances, but it is not a definite material since kerogen compositions differ when derived from differing shales.

While oil shales have been utilized for centuries as a source of fuel, such uses have generally been small, and the great potential for the huge deposits in various locations around the world remains to be unlocked on a feasible commercial scale.

Shale oil is a dark, viscous organic liquid obtained by pyrolyzing oil shale. Refining of the shale oil is similar to the handling of crude petroleum as far as the basic refining steps and end use products are concerned. Shale oil, of course, is not "crude oil". Destructive pyrolysis of crushed shale yields shale oil, but under the pyrolysis conditions commonly employed, a disproportionation of carbon and hydrogen structures equivalent to internal hydrogenation is believed to occur. A large percentage of this heavy kerogen converts to a liquid, some to light gases, and the rest remains as a carbon-rich residue on the inorganic matrix. Shale oil in some respects may be considered as intermediate in composition between petroleum and coal tar, comparing for example the C:H atomic ratio of about 6:7 for petroleum, about 7:9 for shale oil, and about 10:16 for coal carbonization products.

The Tosco process of retorting oil shales employs a cocurrent flow of hot ceramic balls and oil shale in a rotating drum means. The oil shale takes up heat from the balls, and the oil vapors produced are drawn off into a collection system, leaving a spent shale admixed with the balls. The spent shale is transferred to a furnace where residue-carbon is burned off to provide reheating of the balls. The main advantages of the Tosco system are the relatively high throughput rates achieved in proportion to the size of equipment, and the production of high-BTU off-gas since there is no dilution thereof by combustion products. However, one serious disadvantage of the Tosco process has been just how to separate the ceramic balls from the spent shale.

BRIEF DESCRIPTION OF THE INVENTION

I have discovered that iron-containing refractory balls, containing sufficient iron in a magnetic state, when used in the Tosco retorting process for oil shale, provide for the effective magnetic separation of the balls from the spent shale.

The iron can be incorporated in a ceramic shell around a plain ceramic core, or mixed throughout the ceramic balls, or in the interior of the ball with a ceramic shall therearound.

It also presently appears that where the iron-containing balls contain surface iron that these desirably tend to catalyze the shift of CO in the retort to $CO_2$ and $H_2$ via the reaction of $CO+H_2O \rightleftarrows CO_2+H_2$.

DESCRIPTION OF THE FIGURE

Crushed raw shale 1, preferably fed via a surge hopper (not shown), is fed to a shale preheater 2 which receives hot flue gases 3 in order to preheat the shale and produce a preheated shale 4. The cooled gases 5 preferably are scrubbed by a scrubber 6 to provide clean gases 7 for discharge to the atmosphere. The preheated shale 4 is combined with hot ceramic balls 8 into a pyrolysis drum 9 for conversion of the kerogen contained in the oil shale to shale oil.

In my drawing, separation of the hot balls is accomplished at the outlet 11 of the pyrolysis drum 9 by a magnetic separator 12 by which the now hot carbonaceous-coated ceramic balls are separated 13 from the shale oil and spent oil shale. The shale oil and spent oil shale 14 are sent to separator 15. Of course, the shale oil can be first separated, if desired, and then the hot carbonaceous iron-containing ceramic balls subsequently separated from the hot spent shale.

The oil shale and shale oil 14 are separated such as in a shale separator 15, such as a gravity separator, to provide a stream of spent shale 16 which preferably is cooled (not shown) before final disposal, such as to an area from which the oil shale had already been mined. Cooling of the hot spent shale 16 can be accomplished, if desired, by such as preheating air 25 for use in reheating 24 spent balls 13, or can be used to assist in preheating the crushed raw shale by indirect heat exchange therewith (not shown).

The separated shale oil 18 is fractionated 19 to provide suitable streams such as of hot off-gas 21, naphtha 22, gas oil 23, and residue 24, for further processing. The carbonaceous coated hot balls are conveyed 13 to a ball heater 24 where at least a portion of the hot off-gases 20 and **21*a* from fractionation 19 together with air 25 are used to burn off the carbonaceous residue and produce clean hot balls 8 for return to the pyrolysis drum 9. The hot flue gas stream 3 effluent from the ball heater 24 provides a source of hot flue gases for the shale preheater 2. Excess off-gases 21 can be used, if desired, to partially preheat (not shown), preferably by indirect heat exchange, the incoming crushed raw shale 1**.

DETAILED DESCRIPTION OF THE INVENTION

In accordance with my process, the refractory balls for use in my modified Tosco retorting process for oil shale are prepared so as to incorporate iron in a magnetic form.

These balls preferably are of a high alumina refractory. A high alumina refractory preferably should compromise about 85 to 95 percent $Al_2O_3$, less than 10 percent silica, and may and usually will contain traces of iron and titanium oxides typically in the order of such as about 1 to 2 percent. Any such naturally occuring or included from oxides are not sufficient magnetic properties of significance to provide sufficient magnetic properties to the ceramic balls heretofore employed. The iron-containing ceramic balls employed in accordance with my invention contain sufficient iron to impart effective magnetic separation characteristics, such as about 10 to 90, preferably about 20 to 80, more preferably about 30 to 60 weight percent.

In accordance with my process, the size of the iron-containing balls can range widely so long as effective, but generally will have a diameter of such as about $\frac{1}{8}''$ to 2", preferably about $\frac{3}{8}''$ to $\frac{5}{8}''$, presently more preferably and presently conveniently about $\frac{1}{2}$ inch in diameter. The balls containing iron can range somewhat in size, depending on the density, and particular operating characteristics employed in the Tosco process. The balls need not be truly spherical, but can vary somewhat, such as between spherical, and, for example, egg- or nut-shaped.

Suitable ceramic balls containing magnetic iron can be made by various methods. For example, a suitable high-alumina refractory in finely powdered form, such as about 5 to 10 micron particles, water, and iron particles, such as filings or shot, can be admixed in a pug mill mixer to produce an extrudable admixture, and extruded into cylinders of such as about $\frac{1}{4}\times\frac{1}{4}$ inch to $\frac{1}{2}\times\frac{1}{2}$ inch, or as suitable to result in the final desired sizing as discussed above. The cylinders then can be tumbled in a rotary drum so as to provide balls suitable size, such as of the order of such as about $\frac{1}{4}$ to $\frac{1}{2}$ inch diameter.

In an alternative method, finely divided high-alumina refractory and water are admixed, but without the iron, and formed in an extruder to provide cylinders of suitable size. These cylinders are tumbled in a rotary drum so as to provide a first sized wet alumina balls. These first-sized wet alumina balls are admixed with iron filings or shot in a second rotary drum step, so as to coat the first formed balls with the iron filings. These iron-filing coated alumina balls then are admixed with further water and further high-alumina, such as in further rotary drum step, so as to provide, in effect, a ball with a ceramic core, an iron filing coating thereover, and over that additional alumina.

Another alternative mode or preparation includes admixing the finely divided refractory-grade alumina and water, but without any iron, to form a thick mixture which is passed through a roll-type briquetting machine, pelleting mill, or tableting press. Prior to passing the alumina mixture into the cavities of the mill or press, an iron particle such as a burr is inserted into each cavity and can be held in the cavity by such as a cleat or small magnet. The iron-particle containing pellets are subsequently treated to produce balls in effect with an internal iron piece or burr.

Another suitable method is to use iron shot, tumble the iron shot with the powdered high refractory-grade alumina and sufficient water to result in an alumina-coated shot, thus a ball with a iron center.

Any of these methods, or any others known to those skilled in the ball arts, provide iron-containing pre-balls which then are fired in such as a kiln at temperatures of the order of about 2800° to 3400° F., preferably such as about 3000° to 3200° F., for a sufficient time such as about $\frac{1}{2}$ to 5 hours. Firing need not be in an oxygen free atmosphere. The fired iron-containing ceramic balls are cooled, preferably in the substantial absence of oxygen, and stored as needed for use in my modification of the Tosco process.

An alternative process to making the iron-containing balls, and one that may well be quite attractive considering the fact that it uses some of the spent shale, is to employ fine particles of spent shale of such as up to about $\frac{1}{8}''$ to $\frac{1}{4}''$ particle size, treat these with dilute alkali such as caustic soda of such as about 0.5 N in leach mixer means at a temperature of such as about 60° to 90° F. to provide an alkaline slurry of such as about 40 weight percent solids. This slurry is separated and washed in solid-liquid separator means, such as a centrifuge, and the solid materials are separated out to waste. The liquor, containing dissolved alumina, preferably heated to an elevated temperature of such as about 150° F., is adjusted as to pH with an alkali metal hydroxide such as sodium hydroxide, to result in a floc which is substantially aluminum hydroxide. The aluminum hydroxide floc can be admixed with iron filings or shot, having a particle size of such as about 0.001 to 0.1 inch, and the mixture separated such as by filtration or centrifugation followed by washing to remove dissolved salts and water. The filter cake, now containing such as about 85% $Al_2O_3$ as $Al(OH)_3$, can be admixed with high alumina ceramic material, if desired, dried as necessary, extruded, and employed as hereinbefore described to produce an iron-containing ceramic ball.

As will have been noted, certain of the processes tend to result in a limited amount of iron substantially on the surface of the ceramic ball. It is to be anticipated that such surface iron may tend to promote formation of carbon at the surface of the ball at the reducing conditions involved in retorting of the shale oil, which may tend to decrease somewhat the life of the balls. Of course, such carbon effectively will be substantially burned off at the time of air treatment of the ball. Processes of ball-making by which most of the iron is internal tend to minimize this effect. At the same time such surface iron is presently believed to be advantageous in promoting the shift of CO in the retort to $CO_2$ and $H_2$.

In accordance with my modification of the Tosco process, raw oil shale is crushed to a small readily handled size, such as about $\frac{1}{8}$ to 2 inch, and preferably processed through a surge hopper so as to provide a reservoir of the crushed raw shale. The crushed raw oil shale optionally can be at least partially pre-heated by initial indirect heat exchange with hot spent shale, thus conserving energy in the overall process. The crushed oil shale, optionally partially preheated, is preheated in a preheater means by direct contacting with hot flue gases as hereinafter described. The hot flue gases preheat the crushed shale to a suitable temperature of such as about 300° F. to 700° F., preferably such as about 500° F., in a dilute-phase fluid bed operation.

The preheated shale and flue gases then are separated. The flue gases are still sufficiently hot as to permit recovery in such as a waste heat boiler, if desired. The existing flue gases preferably are scrubbed before release to the atmosphere. The preheated shale is admixed in a retort means, such as a rotating pyrolysis drum, with hot ceramic iron-containing balls, preferably under cocurrent flow conditions. The hot ceramic iron-containing balls generally are preheated to a temperature of such as about 1000° F. to 1800° F., more usually about 1200° F. prior to admixture with the preheated crushed oil shale. Usually such as about 2 tons of the heated balls are circulated per ton of preheated oil shale. These hot balls when admixed with the preheated crushed oil shale result in a mixture temperature of such as about 850° F. to 1050° F. Under these conditions the kerogen in the oil shale is converted to a variety of materials, forming shale oil which also contains minor amounts of nitrogenous compounds and oxygenated compounds. Some carbonaceous residues may tend to build up on the ceramic balls during the pyrolysis of the oil shale.

The admixture of spent shale, shale oil, and spent carbonaceous ceramic balls, then is treated for separation. Some light ends can be removed at the pyrolysis drum, though more usually the entire pyrolysis admixture is treated to separate the hot spent balls, the hot spent shale, and the shale oil. Separation of the hot carbonaceous spent balls can be readily accomplished by means such as magnetic separator means which is of a type such as a Dings induced-roll separator, rotor-type electrostatic separator, or other commercially available suitable magnetic separator means. The admixture of spent shale and oily materials comprising the shale oil can be separated in a gravity-type vapor-solid separator, such as a Howard gas-solids separator. It presently is considered preferable for materials-handling purposes and equipment sizing, to separate the hot spent balls substantially at the exit of the contacting means, and subsequently separate the shale oil from the spent shale. However, if desired, the shale oil can be first separated and subsequently the spent balls and spent shale can be separated. The separated spent shale is preferably cooled to conserve energy and for final disposal. The hot spent shale, 16 on my drawing, can be at least partially cooled, if desired, such as by bringing it into indirect heat exchange (not shown) with the incoming crushed raw shale in order to at least in part partially preheat the crushed raw shale. Another option (not shown) is to use the hot spent shale to preheat, preferably by indirect means, the air tube employed in the ball heater so as to conserve energy and also to minimize hydrocarbon vapor emissions to the atmosphere.

The shale oil itself preferably is fractionated to provide such fractions as may be desired, such as an off-gas, and heavier, such as naphtha, gas oil, residue, as well as an off-gas 20 comprising light ends suitable for use in part in preheating the spent balls. Any such off-gas 21 not so needed can be otherwise employed as necessary or desired, such as in power generation for other equipment, and the like.

The separated spent balls are conveyed to a ball heater means where the balls are reheated by combustion of at least a portion of the off-gas from the fractionator, together with air, which reheating process also substantially burns off any carbonaceous residues, and reheats the balls to the desired temperatures for recycle.

The following Table I provides a calculated material balance to assist in the further understanding of my invention. Stream numbers are coordinated with my drawings, and with the discussion hereinabove.

TABLE I

MATERIAL BALANCE

Basis: Raw oil shale 1,000 tons per unit time, producing 25 gallons of shale oil per ton of oil shale.

| | Raw Shale | Flue Gas | Pre-heated Shale | Cooled Gases | Clean Dis-charge Gases | Heated Balls | Re-cycle Balls |
|---|---|---|---|---|---|---|---|
| Stream | 1 | 3 | 4 | 5 | 7 | 8 | 13 |
| Tons | 1000 | 270 | 980 | 290 | 290 | 2000 | 2000 |

| | Spent Shale | Shale Oil | Off Gas | Fractionated Liquid Products | | | Combustion Air |
|---|---|---|---|---|---|---|---|
| Stream | 16 | 18 | 20 | 22 | 23 | 24 | 25 |
| Tons | 860 | 120 | 20 | 100 Total | | | 250 |

The above material balance further exemplifies my modification of the Tosco process.

This disclosure illustrates the value and effectiveness of my invention. The examples, the knowledge and background of the field of the invention and general principles of applicable sciences, have formed the bases from which the broad descriptions of the invention including the ranges of conditions and operant components have been developed, which form the bases for my claims here appended.

I claim:

1. Iron-containing ceramic balls having a diameter of about $\frac{1}{8}''$ to 2" and containing about 10 to 90 weight percent iron, said ceramic content of said balls being a high temperature fired high-refractory alumina, wherein said iron-containing ceramic balls are characterized in cross-section by an alumina ceramic core, shell of iron particles around said core, and an outer coating of alumina ceramic.

2. The iron-containing alumina balls in accordance with claim 1, further characterized by a diameter of about $\frac{3}{8}''$ to $\frac{5}{8}''$.

3. The iron-containing alumina balls in accordance with claim 1, further characterized by a diameter of about $\frac{1}{2}''$.

4. The iron-containing alumina balls in accordance with claim 1, having about 20 to 80 weight percent iron and the balance ceramic alumina.

5. The iron-containing alumina balls in accordance with claim 1, having a diameter of about $\frac{3}{8}''$ to $\frac{5}{8}''$ and an iron content of about 20 to 80 weight percent.

* * * * *